US005861701A

United States Patent [19]

Young et al.

[11] Patent Number: 5,861,701

[45] Date of Patent: Jan. 19, 1999

[54] CHARGED-PARTICLE POWERED BATTERY

[75] Inventors: Robert D. Young; John P. Hageman; Glenn M. Light, all of San Antonio; Stephen W. Seale, Jr., La Vernia, all of Tex.

[73] Assignee: Southwest Research Institute, San Antonio, Tex.

[21] Appl. No.: 663,704

[22] Filed: Jun. 14, 1996

Related U.S. Application Data

[63] Continuation-in-part of Ser. No. 613,425, Mar. 11, 1996, abandoned.

[51] Int. Cl.[6] ..... G21H 1/00; G21H 1/04

[52] U.S. Cl. ..... 310/305; 310/304

[58] Field of Search ..... 310/304, 305; 136/252, 253

[56] References Cited

U.S. PATENT DOCUMENTS

| | | | |
|---|---|---|---|
| 2,728,867 | 12/1955 | Wilson | 310/305 |
| 2,847,585 | 8/1958 | Christian | 310/303 |
| 2,858,459 | 10/1958 | Schwarz | 310/304 |
| 3,094,634 | 6/1963 | Rappaport | 310/303 |
| 4,178,524 | 12/1979 | Ritter | 310/304 |
| 4,663,115 | 5/1987 | Russell | 310/304 |

*Primary Examiner*—Clayton E. LaBalle
*Attorney, Agent, or Firm*—Akin, Gump, Strauss, Hauer & Feld, L.L.P.

[57] ABSTRACT

An improved high energy-density battery for producing continuous low-voltage electrical energy is powered by direct conversion of the kinetic energy of charged particles to electrical potentials. An improved battery comprises at least one primary energy source and a plurality of cells, each cell comprising a secondary electron emitter plate spaced apart from a collector plate. Cells are configured to maximize the number of relatively low-energy secondary electrons from the emitter plates which reaches and is retained by collector plates. Heat production is minimized during efficient energy conversion of the relatively high-energy of primary charged particles to the lower energy but relatively high current capacity of large numbers of secondary electrons. Material work functions and Fermi levels of the emitters and collectors are chosen to favor emission of secondary electrons from emitter plates and retention of secondary electrons impinging on a collector plate, thus increasing efficiency and reducing internal battery leakage currents. Relatively low cell voltages and low heat losses in the direct conversion process mean that the energy sources may be confined in relatively small packages suitable for powering (and mounting in close proximity to) electronic microcircuits and sensors.

23 Claims, 1 Drawing Sheet

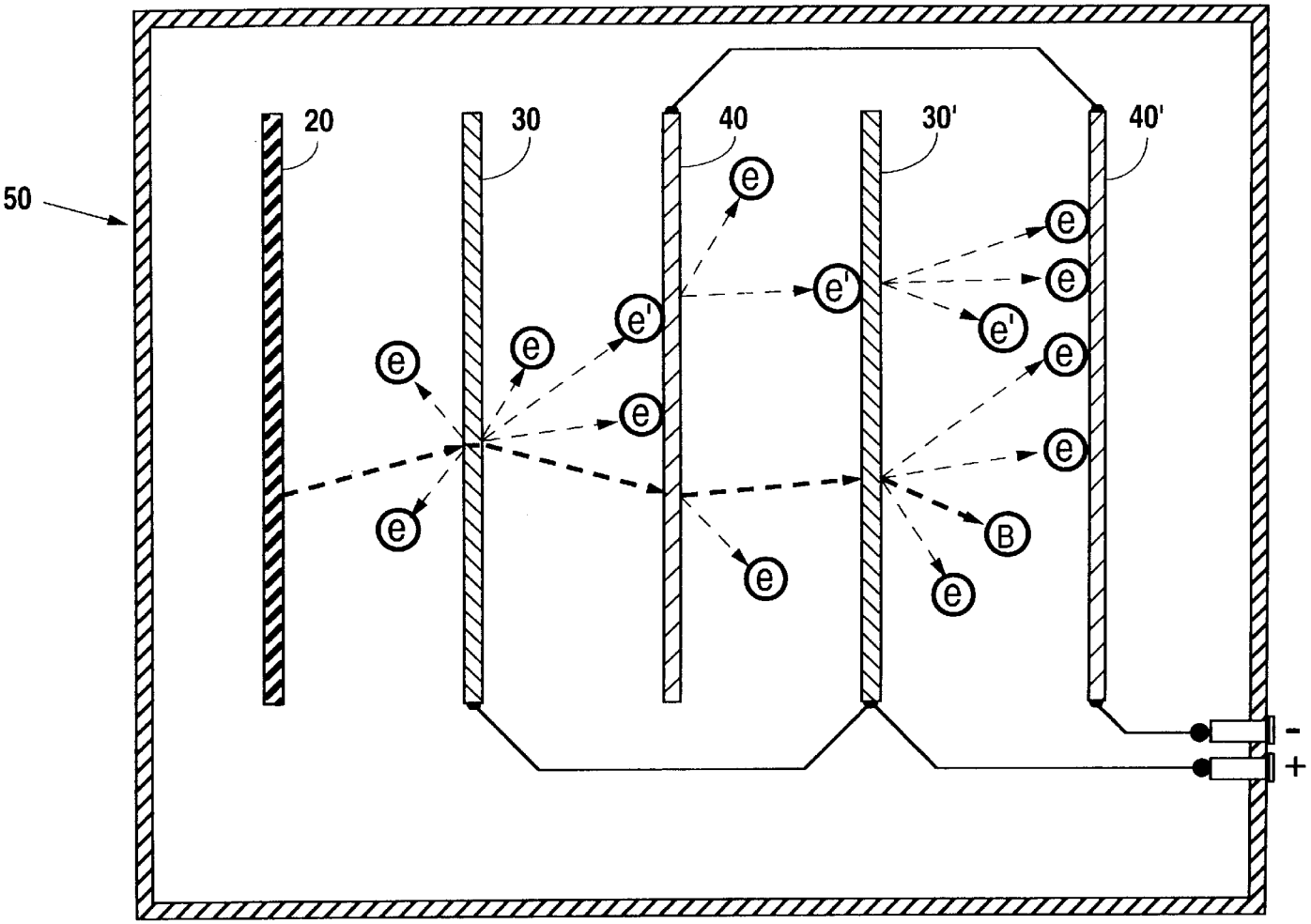
40'
30'
40
30
20
50
B
e
e'
-
+

CHARGED-PARTICLE POWERED BATTERY

This application is a continuation-in-part of application Ser. No. 08/613,425 filed 11 Mar. 1996 now abandoned.

BACKGROUND

FIELD OF THE INVENTION

The invention relates to methods and apparatus for conversion of charged particle kinetic energy to electrical energy.

METHODS OF ENERGY CONVERSION

During the 1950's major attempts were made to use nuclear power sources in satellites because of their relatively long life and high energy density. These cumbersome units were required to generate kilowatts of electrical power and were in great demand. Although rudimentary technology for direct conversion from nuclear to electrical energy had been developed in the prior two decades, direct methods were not widely used for satellite applications. Instead, indirect conversion methods (i.e., those involving an intermediate heating step) were favored because they produced relatively large quantities of electrical power at higher efficiencies than were achieveable by direct methods.

Subsequently, as lower power applications for long-life batteries became more numerous, interest was again focused on direct production of electrical currents using radionuclide sources. See U.S. Pat. No. 2,728,867, issued Dec. 27, 1955 (Wilson), incorporated herein by reference. Wilson describes the use of charged particle (beta) emission and collection plates to establish a potential (voltage) in a capacitor type arrangement. Such batteries were generally designed to produce relatively low currents at relatively high terminal voltages (kilovolts, for example), reflecting their design and the relatively high energy of the alpha, beta, gamma or X-radiation involved. For an example of a photoelectric generator, see U.S. Pat. No. 4,178,524, issued Dec. 11, 1979 (Ritter), incorporated herein by reference.

While high-voltage direct conversion batteries have found many uses, however, they are not ideally suited to many modern solid-state electronic applications. The past four decades of integrated microcircuit development have been characterized by decreasing power requirements and a shift from analog to digital technology. Many electronic power supplies now operate in the range of three to five volts DC, delivering microwatts to milliwatts. Indeed, power requirements for electronic applications in general have been reduced by more than an order of magnitude over the past decade and are continuing to decline. But the currently available long-life batteries are still practically limited by their design to operation at terminal voltages far in excess of what is needed for most microelectronic applications.

Lower Voltage Sources Using Secondary Emission

Secondary electron emission from an emitter toward a collector can substantially improve performance in a long-life, low voltage (but relatively high-current) battery. If several relatively lower-energy electrons are ejected from a secondary emitter which is struck by a relatively high-energy alpha or beta particle, twin benefits result. The energy of the alpha or beta particle is effectively reduced, even as the maximum current available to a circuit which carries the secondary electrons is increased. See U.S. Pat. No. 2,527,945, issued Oct. 31, 1950 (Linder), incorporated herein by reference.

To maximize secondary emission, particles radiated from a relatively high-energy (primary emitter) source would preferably be slowed to an energy level compatible with the secondary emitter. A device using this technique is described in U.S. Pat. No. 2,858,459, issued Oct. 28, 1958 (Schwarz), incorporated herein by reference. This device incorporates a moderating layer of radiation-resistant material (the absorber) both to slow high-energy primary particles and to prevent the drift of secondary electrons back to the source.

Unfortunately, all of the available lower-energy secondary electrons may not flow in an external circuit as desired if some of them are repelled back toward the secondary emitter by the negative space charge surrounding the collector. This problem has been recognized for many years, and was addressed in vacuum tube applications by placing the anode sufficiently close to the multiplying (secondary emission) electrode to substantially reduce space charge effects. See U.S. Pat. No. 2,164,892, issued Jul. 4, 1939 (Banks), incorporated herein by reference.

Note, however, that if the secondary electrons are made sufficiently energetic to penetrate the space charge (so the collector actually captures all of the electrons from the secondary emitter), a further problem results. Some of the captured electrons may impart sufficient energy to other electrons in the collector to cause their ejection and subsequent drift back toward the secondary emitter or even toward the source. Thus, battery performance may be adversely affected by what is effectively a leakage current comprising electrons secondarily emitted from the collector. One method proposed for reducing this leakage current involves placing a grid, which is biased at a relatively low negative potential, between the collector and the source. It is evident that inclusion of such grids and the power supplies to establish suitable bias potential would significantly complicate both battery construction and operation.

Lower Voltage Sources Using p-n Junctions

Another method of directly producing relatively low-voltage electrical power using a relatively high-energy radionuclide source is to irradiate a semiconductor device comprising one or a plurality of p-n semiconductor junctions connected in series or parallel. See U.S. Pat. No. 3,094,634, issued Jun. 18, 1963 (Rappaport), and U.S. Pat. No. 3,706,893, issued Dec. 19, 1972 (Olsen et al.), both incorporated herein by reference. But the p-n junction devices of Rappaport and Olsen et al. do not incorporate the advantages of secondary electron emission, and they are used with relatively low-energy radionuclide sources (such as promethium-147) because of the substantially increased likelihood of damage to semiconductors exposed to relatively higher-energy sources (such as strontium-90).

Thus, radiation energy limitations, excessive leakage currents, and high terminal voltages have combined with cost, safety and fabrication problems to limit the use of nuclear energy sources in relatively low-power applications. A long-life low-voltage power source adapted for use with modem integrated microcircuits (preferably having a specific energy density of about one watt-hour per gram) would find many uses but is not commercially available. Further, the devices and methods referenced above can not be used to produce such a power source.

SUMMARY OF THE INVENTION

The present invention includes methods and apparatus for building a charged-particle powered electrical source (an improved battery) for continuously-powered low-energy applications such as, e.g., integrated microcircuits and/or sensors (the improved battery often being small enough to be incorporated on the same substrate or otherwise in a modular assembly with the microcircuits and/or sensors). An improved battery comprises at least one primary energy source (for producing a plurality of primary charged particles having kinetic energy) and a plurality of plate pairs or cells in which an electrical potential exists between the plates of a plate pair, the cells being electrically connected. Cells may be connected, for example, in series (negative plate of a first cell to positive plate of a second cell) or in parallel (positive and negative plates of a first cell connected respectively to positive and negative plates of a second cell), or certain cell groups may be connected in series while other cell groups are connected in parallel. Each cell comprises a secondary emitter plate (for producing secondary electrons) spaced apart from (and sufficiently electrically insulated from) a collector plate (for collecting secondary electrons emanating from the secondary emitter plate), the secondary emitter intercepting at least a portion of the primary charged particles from at least one primary energy source. Primary charged particles may comprise non-nuclear energetic particles (electrons, protons, ions) and/or energetic particles from nuclear decay (alpha particles, beta particles, positrons). The maximum kinetic energy of primary charged particles is preferably equivalent to at least twice a predetermined maximum cell potential (that is, the maximum potential between the two plates of any plate pair).

Primary charged particles are identified in the present invention as charged particles which, when intercepted by a secondary emitter plate, may impart sufficient kinetic energy to one or more (secondary) electrons to cause their emission from the emitter plate. If only a portion of a primary charged particle's total kinetic energy is imparted to secondary electrons emitted from a single emitter plate, the particle's movement may continue with reduced kinetic energy until the particle is intercepted by another emitter plate with the possible emission of one or more additional secondary electrons. Note that a secondary electron itself may have sufficient kinetic energy so that, when subsequently intercepted by one or more secondary emitter plates, one or more additional secondary electrons may be emitted. For any embodiment of the improved battery, a majority of primary charged particles (preferably substantially all of them) will carry either a negative charge or a positive charge.

In the improved battery, the (relatively higher) kinetic energies of (relatively few) intercepted primary charged particles are incrementally converted to (relatively lower) kinetic energies of (relatively many) secondary electrons. These incremental kinetic energy conversions take place as the primary charged particles each pass through a plurality of cells comprising relatively thin plates. Note that the moderating layer of Schwarz is not present as such in preferred embodiments of the improved battery of the present invention. The moderating layer of Schwarz slowed relatively high-energy charged particles by converting a portion of their kinetic energy to heat. An additional portion of intercepted-particle kinetic energy was converted to the (relatively low) kinetic energy of secondary electrons which could not materially contribute to external electrical current flow because of the relatively high cell potential described in Schwarz. In contrast, each of the relatively thin plates of the improved battery preferably produces relatively large numbers of secondary electrons (preferably with minimal production of heat) in light of the electron interaction cross-section characterization curve. While characterized as having relatively low kinetic energy, secondary electrons in an improved battery nevertheless are preferably sufficiently energetic to traverse the space separating emitter plate from collector plate. Effectively collecting and retaining these relatively low-energy secondary electrons makes them available for flow in an external circuit, an outcome which was neither described nor suggested in Schwarz.

Each interception by a secondary electron emitter plate of the improved battery of a primary charged particle thus preferably incrementally reduces the kinetic energy of the particle (that is, reduces the particle's kinetic energy by an amount less than the particle's total kinetic energy) while imparting at least a portion of the kinetic energy increment to a plurality of secondary electrons. Each secondary electron then preferably has an imparted kinetic energy at least equivalent to (preferably slightly exceeding) a predetermined cell electrical potential. In other words, when a preferred electron kinetic energy is measured in eV (electron volts), its numerical value preferably slightly exceeds the predetermined (equivalent) cell electrical potential measured in V (volts). The total of kinetic energy imparted to secondary electrons emerging from any secondary electron emitter plate intercepting a primary charged particle is preferably substantially equal to the increment by which the energy of that primary charged particle is reduced through interaction with that emitter plate.

Note that primary charged particles which pass through the secondary emitter plate of a cell will in general also pass through the collector plate of the same cell. The effects of these passages, however, differ. In any cell of an improved battery, the emitter and collector plates are distinguished by at least one functional characteristic, that being the relatively higher yield from the emitter of secondary electrons having imparted kinetic energies at least equivalent to the predetermined cell electrical potential following cell interception of a plurality of primary charged particles. This relatively higher secondary electron yield in emitter plates will preferably be obtained by appropriate choices of plate materials, plate coatings, and/or plate geometry. For example, insulating materials generally yield more secondary electrons than conductive materials in similar applications. Differential secondary electron emission from secondary emitter plates and collector plates can also be attained through emitter plate coatings (such as magnesium oxide over platinum or carbon) which increase secondary electron emission relative to that of a collector plate comprising, for example, a thin (for example, about 100 nm thickness) carbon film. Still another method to achieve a desired cell plate differential in secondary electron emission is through control of plate geometry to maximize the probability of interaction with primary charged particles and minimize self absorption of secondary electrons in emitter plates. Additionally or alternatively, collector plate geometry may be controlled to minimize the probability of interaction with primary charged particles and maximize self absorption of secondary electrons.

To enhance both the emission of low energy secondary electrons from the emitter plate and the subsequent capture and retention of these secondary electrons by the (preferably relatively closely spaced compared to emitter plate dimensions) collector plate, improved batteries of the present invention preferably operate at a maximum cell potential (that is, between the collector plate and the secondary electron emitter plate of each cell) not to exceed about 50 V. Even more preferably, maximum cell potential for many microelectronic power applications is less than about 3 V to about 10 V. Additionally, materials for cell plates are preferably chosen to maximize enhancement factor (1) below comprising Fermi energy levels (F) and material work functions (W) of the emitter (subscript e) and collector (subscript c) plates.

$$(F_c-F_e)+(W_c-W_e) \quad (1)$$

Note that material constraints for certain improved battery designs may require that either of the differences in expression (1) above be maximized even if the other difference is not maximized or is even relatively unfavorable. In general, however, both differences are preferably maximized where practical.

Methods for Building an Improved Battery

As noted above, the present invention includes a method of making a charged-particle powered battery. The method comprises providing at least one primary energy source for producing a plurality of primary charged particles having kinetic energy. In addition, a plurality of electrically connected cells is arranged proximate each primary energy source, each cell comprising a secondary emitter plate for producing secondary electrons spaced apart from a collector plate for collecting secondary electrons emanating from the secondary emitter plate. At least one secondary emitter intercepts at least a portion of the primary charged particles from at least one primary energy source. Given such a battery configuration, one may then apply a variety of design criteria alternatively to subsequent steps in building an improved battery.

For example, as a first alternative, a preferred cell potential is chosen for each cell of the plurality of cells, and a composition (comprising, for example, one or more radioisotopes which each predominantly produce a desired charged particle type having a desired maximum energy) is established for each primary energy source. The preferred energy source composition is such that, with each cell of the plurality of cells having a cell potential substantially equal to the preferred cell potential, at least a portion of the primary charged particles have kinetic energy sufficient to impinge on at least two of the secondary emitter plates.

As a second alternative when considering a given primary energy source, one may choose a preferred cell potential for each cell of the plurality of cells such that at least a portion of the primary charged particles from the given source impinge on at least two of the secondary emitter plates. A third alternative when considering a given primary energy source and a preferred cell potential for each cell comprises choosing a preferred geometry for each emitter plate and collector plate of each cell of the plurality of cells such that at least a portion of the primary charged particles impinge on at least two of the secondary emitter plates.

Preferred methods of making an improved battery may also comprise an additional step comprising choosing materials for each collector plate and each emitter plate so that cell collector Fermi energy levels exceed cell emitter Fermi energy levels for each cell. Analogously one may choose materials for each collector plate and each emitter plate so that cell collector material work functions exceed cell emitter material work functions for each cell. And one may also choose materials for each collector plate and each emitter plate so that cell collector Fermi energy levels exceed cell emitter Fermi energy levels for each said cell and cell collector material work functions exceed cell emitter material work functions for each said cell.

Note that at least a portion of the primary charged particles in preferred embodiments of the improved battery preferably have kinetic energy which is incrementally reduced on interaction with at least one secondary emitter plate, and the chosen cell potential preferably is less than about 50 V and even more preferably less than about 3 V to about 10 V.

BRIEF DESCRIPTION OF THE DRAWING

The drawing schematically illustrates a side elevation cross-section of a preferred arrangement of structural components of a charged-particle powered battery.

DETAILED DESCRIPTION

Structural components of a charged-particle powered battery are schematically illustrated in the drawing to show a representative path of a charged particle B from a primary energy source 20. The energy source 20 (shown for illustration purposes as a side elevation or edge-on cross-sectional view of a plate) preferably predominantly produces one type of the primary charged particles (nuclear or non-nuclear energetic particles) described above. For example, the illustrated energy source 20, producing primarily beta particles B, may comprise strontium 90 or carbon 14. Note that although energy source 20 is schematically illustrated as a structure spaced apart from collector and emitter plates, preferred embodiments of the improved battery may incorporate an energy source 20 within one or more secondary emitter plates 30,30'. Physically, a secondary emitter plate in the latter configuration may comprise, for example, a carbon film substrate which itself comprises carbon 14 and which has a magnesium oxide coating.

A beta particle B leaving source 20 preferably impinges on a proximate (thin) secondary emitter plate 30 (illustrated in edge-on cross-sectional view), resulting in emission of a plurality of secondary electrons e and possibly one or more relatively energetic secondary electrons e'. While passing through the secondary emitter plate 30 on its way to (thin) collector plate 40 (illustrated in edge-on cross-sectional view), the beta particle B pathway is deviated and the particle itself has incrementally-reduced kinetic energy, at least a portion of which has been converted to the (relatively lower) kinetic energy of (relatively many) emitted secondary electrons. Analogously, while passing through the (thin) collector plate 40 on its way to secondary emitter plate 30', the pathway of the relatively energetic secondary electron e' may be deviated and the electron itself experience an incremental reduction in kinetic energy, at least a portion of which has been converted to the (relatively lower) kinetic energy of (relatively few) secondary electrons emitted from collector plate 40. A further portion of the kinetic energy of electron e' is then shown being converted to the (relatively lower) kinetic energy of (relatively many) secondary electrons emitted from emitter plate 30' (two of which are schematically illustrated as being captured by collector plate 40').

In addition to beta particle B and relatively energetic secondary electron e' shown in the drawing as moving toward collector 40, a portion of the remaining secondary electrons emitted from plate 30 is also moving toward collector 40 (two secondary electrons e are shown being captured by collector 40). Note that secondary electron emission by plate 30 and subsequent capture and retention by collector 40 of these secondary electrons will preferably be enhanced by appropriate choice of material work functions and Fermi energy levels in the emitter and collector plates as described herein.

As in the case of relatively energetic electrons e', beta particle B (schematically illustrated impinging on collector plate 40) causes release of relatively fewer secondary electrons e than would be expected to be released from adjacent secondary emitter plates. Again, beta particle B changes its course (during passage through collector plate 40) on its way to another (thin) secondary emitter plate 30'. A plurality of secondary electrons e is emitted from secondary emitter plate 30', a portion of which is then captured by (thin) collector plate 40' (two such electrons are schematically illustrated as being captured by collector plate 40'). Beta particle B may continue through collector plate 40' (causing the emission of relatively few secondary electrons) but its kinetic energy will again have been incrementally reduced. Improved batteries may have many cells and will preferably be designed to transform substantially all of the kinetic energy of the primary charged particles to the kinetic energy of secondary electrons. Preferably, relatively little kinetic energy is transformed to heat in the emitter or collector plates or in shielding 50 (such as lead or stainless steel sheet) which will preferably be present to prevent primary charged particles or other potentially harmful radiation from escaping from the battery.

Accumulation of collected (that is, captured) secondary electrons e as schematically illustrated on collector plates 40,40' gives these plates (shown connected in parallel in the drawing) a negative charge with respect to secondary emitter plates 30,30' (shown connected in parallel in the drawing). Thus, emitter plate 30 and collector plate 40 comprise a first cell, while emitter plate 30' and collector plate 40' comprise a second cell, the first and second cells being electrically connected in parallel and to the terminals of the improved battery. Note that whenever the energy source 20 is present, a cell potential will exist and will tend to increase. Space charge, for example, and other effects such as internal leakage currents will tend to limit any rise in cell potential, but preferred embodiments of the improved battery may also comprise maintenance circuits to manage load on the battery cells for optimal energy conversion and battery life and/or minimum heating.

Note that specification of various improved battery design parameters such as emitter and collector plate materials and geometry, preferred cell potential, the number and location of primary energy sources as well as their composition, plate spacing, dielectric constants of any insulators present between cells and/or between plates of individual cells, the number of cells and the manner of interconnecting them, the type of shielding and heat dissipation capability desired, the preferred temperature rise, and related parameters is a multifactorial design problem. The design approach will depend strongly on the intended application(s) for the improved battery. All improved batteries, however, are characterized by relatively efficient incremental conversion of relatively high kinetic energies of relatively few primary charged particles to relatively low kinetic energies of relatively many secondary electrons, resulting in preferred cell potentials not exceeding about 50 volts and even more preferred cell voltages not exceeding about 3 volts to about 10 volts. The incremental nature of the above energy conversions is reflected in at least a portion of primary charged particles' impinging on (and kinetic-energy-converting interaction with) at least two secondary emitter plates. The resulting substantially stepwise (incremental) reduction in the relatively high kinetic energy of each participating primary charged particle tends to reduce the likelihood of relatively wastful (that is, heat-generating) interactions of the primary charged particle with other structures of the improved battery, thus increasing its efficiency while simultaneously providing relatively low kinetic energy secondary electrons to maintain the relatively low cell potentials so useful in microelectronic and sensor applications.

What is claimed is:

1. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein said primary charged particles have maximum kinetic energy preferably equivalent to at least twice a predetermined maximum cell potential.

2. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein said kinetic energy of each said primary charged particle is incrementally reduced on passage of said particle through a cell, at least a portion of said increment of kinetic energy being imparted to a plurality of said secondary electrons.

3. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein within a cell, said emitter and collector plates are distinguished by a relatively higher yield from said emitter of secondary electrons having imparted kinetic energies at least equivalent to a predetermined cell electrical potential following cell interception of a plurality of said primary charged particles.

4. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein probability of emitter plate interaction with primary charged particles is maximized and emitter plate self absorption of secondary electrons is minimized.

5. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein probability of collector plate interaction with primary charged particles is minimized and collector plate self absorption of secondary electrons is maximized.

6. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein maximum cell potential between said collector plate and said secondary electron emitter plate of each said cell does not exceed about 50 V.

7. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein maximum cell potential between said collector plate and said secondary electron emitter plate of each said cell does not exceed about 10 V.

8. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein maximum cell potential between said collector plate and said secondary electron emitter plate of each said cell does not exceed about 3 V.

9. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein collector Fermi energy levels exceed emitter Fermi energy levels.

10. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein collector material work functions exceed emitter material work functions.

11. A charged-particle powered battery, comprising at least one primary energy source for producing a plurality of primary charged particles having kinetic energy; and a plurality of electrically connected cells, each cell comprising a secondary emitter plate for producing secondary electrons spaced apart from a collector plate for collecting secondary electrons emanating from said secondary emitter plate, wherein a plurality of said secondary emitters intercepts at least a portion of said primary charged particles from at least one said primary energy source, and wherein collector material work functions exceed emitter material work functions and collector Fermi energy levels exceed emitter Fermi energy levels.

12. The charged-particle powered battery of claim 1, 2, 3, 4, 5, 6, 7, 8, 9, 10 or 11 in which at least one primary energy source is spaced apart from said collector and emitter plates.

13. A method of making a charged-particle powered battery, the method comprising providing at least one primary energy source for producing a plurality of primary charged particles having kinetic energy;

arranging a plurality of electrically connected cells proximate each said primary energy source, each cell comprising a secondary emitter plate for producing secondary electrons spaced apart from a collector plate for collecting secondary electrons emanating from said secondary emitter plate, a plurality of said secondary emitters intercepting at least a portion of said primary charged particles from at least one said primary energy source;

choosing a preferred cell potential for each cell of said plurality of cells; and establishing a composition for each said primary energy source such that, with each cell of said plurality of cells having a cell potential substantially equal to said preferred cell potential, at least a portion of said primary charged particles have kinetic energy sufficient to impinge on at least two of said secondary emitter plates.

14. The method of claim 13 wherein at least a portion of said primary charged particles have kinetic energy which is incrementally reduced on interaction with at least one secondary emitter plate.

15. The method of claim 13 wherein said preferred cell potential is chosen to be less than about 10 V.

16. A method of making a charged-particle powered battery, the method comprising providing at least one primary energy source for producing a plurality of primary charged particles having kinetic energy;

arranging a plurality of electrically connected cells proximate each said primary energy source, each cell comprising a secondary emitter plate for producing secondary electrons spaced apart from a collector plate for collecting secondary electrons emanating from said secondary emitter plate, a plurality of said secondary emitters intercepting at least a portion of said primary charged particles from at least one said primary energy source; and choosing a preferred cell potential for each cell of said plurality of cells such that at least a portion of said primary charged particles impinge on at least two of said secondary emitter plates.

17. The method of claim 16 wherein at least a portion of said primary charged particles have kinetic energy which is incrementally reduced on interaction with at least one secondary emitter plate.

18. The method of claim 16 wherein said preferred cell potential is chosen to be less than about 10 V.

19. A method of making a charged-particle powered battery, the method comprising providing at least one primary energy source for producing a plurality of primary charged particles having kinetic energy; and arranging a plurality of electrically connected cells proximate each said primary energy source, each cell having a cell potential and comprising a secondary emitter plate for producing secondary electrons spaced apart from a collector plate for collecting secondary electrons emanating from said secondary emitter plate, at least two said secondary emitter plates intercepting at least a portion of said primary charged particles from at least one said primary energy source.

20. The method of claim 19 wherein at least a portion of said primary charged particles have kinetic energy which is incrementally reduced on interaction with at least one secondary emitter plate.

21. The method of claim 19 comprising the additional step of choosing materials for each said collector plate and each said emitter plate so that cell collector Fermi energy levels exceed cell emitter Fermi energy levels for each said cell.

22. The method of claim 19 comprising the additional step of choosing materials for each said collector plate and each said emitter plate so that cell collector material work functions exceed cell emitter material work functions for each said cell.

23. The method of claim 19 comprising the additional step of choosing materials for each said collector plate and each said emitter plate so that cell collector Fermi energy levels exceed cell emitter Fermi energy levels for each said cell and cell collector material work functions exceed cell emitter material work functions for each said cell.

* * * * *